US006984144B1

(12) United States Patent
Nelson et al.

(10) Patent No.: US 6,984,144 B1
(45) Date of Patent: Jan. 10, 2006

(54) LOW EFFORT, HIGH RELIABILITY QUICK COUPLING MECHANISM

(75) Inventors: Aaron T. Nelson, West Linn, OR (US); Wai Ki Kong, Singapore (SG); Brent R. Jones, Tualatin, OR (US); Yin M. Sia, Singapore (SG)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/018,482

(22) Filed: Dec. 22, 2004

(51) Int. Cl.
*H01R 33/00* (2006.01)

(52) U.S. Cl. ..... 439/374

(58) Field of Classification Search ..... 399/107, 399/110, 124, 125; 439/374
See application file for complete search history.

(56) References Cited

U.S. PATENT DOCUMENTS

| | | | | |
|---|---|---|---|---|
| 3,014,160 | A * | 12/1961 | Brogden | 361/727 |
| 4,335,950 | A * | 6/1982 | Gunzelmann et al. | 399/124 |
| 4,386,841 | A * | 6/1983 | Wakao et al. | 399/125 |
| 4,556,308 | A | 12/1985 | Hoppner et al. | |
| 4,939,622 | A * | 7/1990 | Weiss et al. | 361/727 |
| 5,060,019 | A | 10/1991 | Fukunaga | |
| 5,162,846 | A | 11/1992 | Cahill | |
| 5,265,310 | A | 11/1993 | Ichinokawa | |
| 5,441,421 | A * | 8/1995 | Ponticelli et al. | 439/284 |
| 5,564,163 | A | 10/1996 | Lowry et al. | |
| 6,092,847 | A | 7/2000 | Kwan | |
| 6,175,990 | B1 | 1/2001 | Kato et al. | |
| 6,243,884 | B1 | 6/2001 | Simonson | |
| 6,427,500 | B1 | 8/2002 | Weinerman et al. | |
| 6,499,189 | B2 | 12/2002 | Kondo et al. | |
| 6,510,301 | B2 | 1/2003 | Tanaka | |
| 6,615,019 | B2 | 9/2003 | Fujimoto | |
| 6,857,893 | B1 * | 2/2005 | Patterson | 439/385 |

* cited by examiner

*Primary Examiner*—Tho D. Ta
*Assistant Examiner*—James R. Harvey
(74) *Attorney, Agent, or Firm*—Oliff & Berridge, PLC

(57) ABSTRACT

Module components are packaged individually and delivered in a non-integrated state. These separate modules may be assembled readily without the use of specialized tools. A preferred configuration is a solid ink printer base module and a second module mounted to the base module through a quick coupling, quick release mechanism. The coupling mechanism may include a hinge and a self-actuating catch. A module coupling system with complementary parts on each module comprises: a first module having a coupling housing and a catch engagement surface, and a second module having a physical, three-dimensional guide surface, a biased retractable catch, a catch decoupling device, and a catch reset mechanism.

20 Claims, 13 Drawing Sheets

FIG. 1
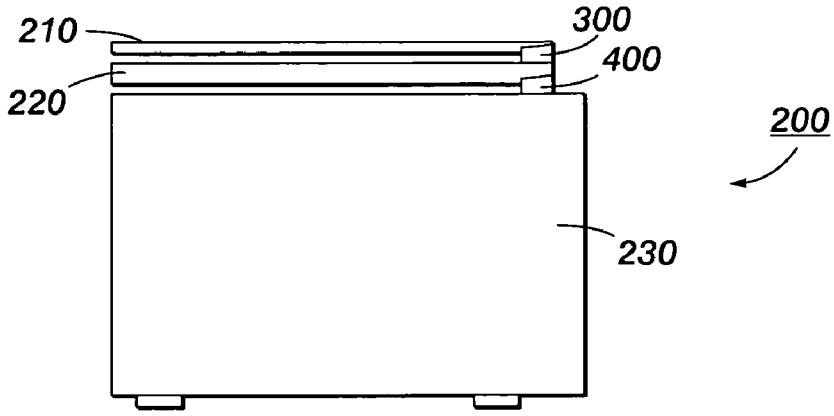
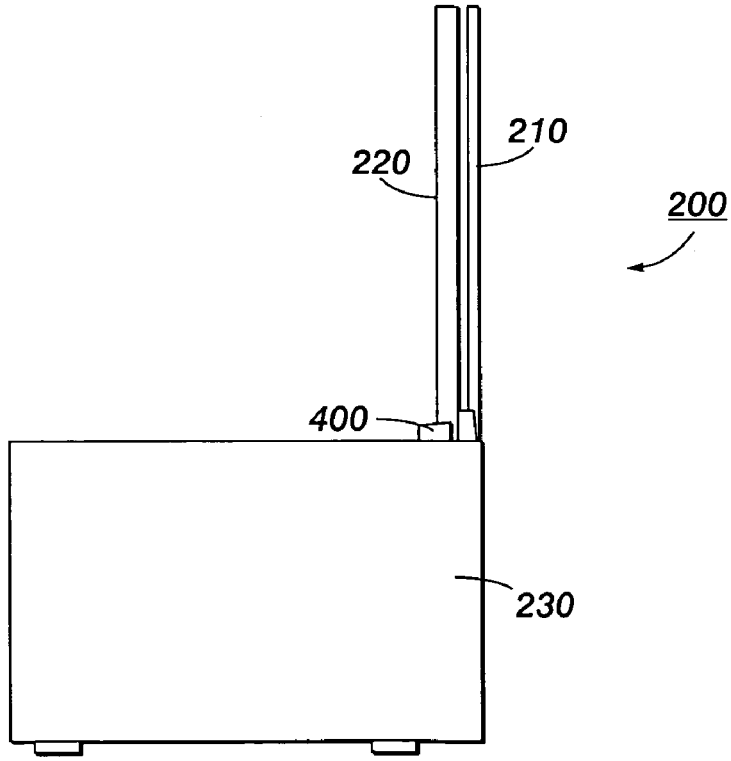
FIG. 2

LOW EFFORT, HIGH RELIABILITY QUICK COUPLING MECHANISM

BACKGROUND

The invention relates to a quick coupling/decoupling mechanism for units that may be assembled by unskilled users. The coupling mechanism may or may not include a hinge function. As a hinging motion is easily incorporated and provides additional functionality, the invention will be described chiefly in that context. The hinge assembly is particularly suited for releasably coupling a first pivoting module to a base module. The hinge assembly may include a self-actuating catch that locks the hinge in a closed position when the upper module is detached from the base module.

Larger systems with modules that cannot be assembled as shipped from the factory place a burden on customers to do assembly steps they may not typically be qualified to perform. This is especially problematic if the operation of or safety of the system or modules being assembled could be compromised as a consequence of incorrect or incomplete assembly.

Printers, copiers, facsimiles and other reprographic products typically have a cover or structural housing that has to be pivoted open to gain access to internal components, such as for ink or toner replenishment, media jams, etc. Copiers and multifunctional printers and devices with printing, scanning and/or copying functions have additional requirements for pivoting covers. Such multifunction devices besides having printing mechanisms may also include scanning mechanisms and may have a feed unit with automatic document feeding mechanisms. The feed unit is normally oriented in a nearly horizontal position. Such feed units must be pivoted open to access a scanner platen glass for document copying or media jam recovery.

Thus, in a reprographic device in which a cover module must be hinged for rotation during normal usage, improper or incomplete assembly of the cover module by a customer may result in serious damage to the various module components, and could pose serious safety concerns to the users of the device should the device not be properly and positively assembled. This is particularly true of devices that move through an extended access pivot range, up to and beyond 90° and are large and/or massive.

Another concern over a product that requires more than nominal assembly by a customer is the customer's response to the actions necessary to place the product in use. Many customers are not tolerant of inappropriate burdens or complex assembly steps.

SUMMARY

Accordingly, it would be advantageous to provide a hinged multi-module product with easier assembly steps. Moreover, in light of safety and operation concerns, it would be advantageous to provide a product having not only simple assembly, but an assembly that can ensure reliable, positive latching, even with inexperienced users.

In accordance with various aspects, hinged module components are packaged individually and delivered in a non-integrated state. In various exemplary embodiments, such separate modules may be assembled readily without the use of specialized tools. In various embodiments, the separate modules may be a base module, such as a reprographic device, and a hinged pivoting module, such as a cover module or a more complex scanning or document feeding assembly mounted to the base module through a detachable hinge assembly.

Orientation and placement of various interrelated but separate modules for assembly can be a difficult task for customers unfamiliar with a product. Thus, common assembly solutions such as a thumbscrew or keyslot can be very unreliable, particularly with large and/or bulky modules where visibility to points of concern is less than optimal. Moreover, thumbscrews and similar "latch after placement" retention structures are often all too easy to improperly or incompletely engage or tighten. Accordingly, there is also a need for a reliable assembly method and structure that can result in simple, positive, reliable retention of module assemblies by a customer or technician.

In accordance with various aspects, a quick coupling mechanism having mount and locate features is provided on separate module components to allow for easy alignment and assembly of the module components in the field.

In accordance with various aspects, a quick coupling mechanism provides a base module with a "set down" landing pad and shoe for receiving a mating "foot print" structure of a corresponding module to be integrated with the base module. In exemplary embodiments, the set down landing pad may accommodate support and initial positioning functions for the corresponding module to encourage correct module orientation and alignment. The set down landing pad can then assist in guiding the corresponding module into a secure positive engagement of the corresponding module within the shoe of the base module.

In preferred exemplary embodiments, the "set down" landing pad provides a support mechanism for the assembler that supports a majority of the weight of the upper module during slide coupling. This allows for the assembly of even heavy module components because the assembly does not need to be supported by the customer during the entire assembly process. Moreover, because the weight is supported, it may become easier for the customer to make any necessary relative position corrections to the module prior to full locking assembly of the module components. Thus, in various embodiments, assembly can be achieved with a set down and slide movement that does not require lifting or supporting of the module during the slide alignment. This provides a higher reliability of alignment and positive coupling.

In exemplary embodiments, the modules may be provided with a securely coupled catch that can automatically lock one module against removal from the other module. In a preferred embodiment, the catch is near a point where sliding engagement reaches a hard stop.

In accordance with various aspects, when the module "foot" is inserted into the complementary "shoe" support of the other module, the guided module may have its movement severely constrained. For example, a "heel" catch may be provided that engages with a rear portion of the guided module, which prevents rearward movement of the module. Moreover, by providing a front stop that limits forward movement and optionally, lateral movement, the two modules can be quickly guided into a positive locking and secure configuration through simple slide and latch movements. Accordingly, assembly can be reliably performed by customers without the need for tools or complex assembly procedures.

Visual indicators may be provided at each of two widely separated parallel coupling assemblies to provide positive feedback that a desired locked condition has been attained. These visual indicators are preferably a component of the pivoting catch so that the visual indication of a locked state cannot occur unless the module being coupled is fully in place. Failure to attain the visual lock indication requires that a further nudge of the module is needed on the side not visibly locked. Adequately applied, this further motion will result in full engagement with visual lock verification. Additionally, visual indicators can be used for initial placement on the landing pad with a correct orientation and alignment.

In exemplary embodiments, removing the coupled module is accomplished by simply sliding a catch latch to a release position, such as with any small object like a screwdriver, Allen wrench, pen, paper clip or the like to unlock the coupling. The catch release may be designed to latch in the unlocked position so that the user does not have to hold it. As the module is slid out of the constraining features of the catch, the lock enabled state of the catch is automatically returned so that it is ready to relock the module when reassembled.

In exemplary embodiments, a module coupling system with complementary parts on each module comprises: visual and physical guide features to align the modules for assembly; position constraining guides to facilitate convenient sliding insertion into a locking position; a module locking catch with integral visual lock position indicator; a decouple catch release mechanism that allows any small cylindrical or pointed object to be used to slide the catch release to a latch position where the modules can be removed without holding the catch release; and a latch release trigger that enables the coupling catch to automatically return to a module receiving and catch enabled state as the module is removed.

In exemplary embodiments, a module coupling system for separately provided module components comprises: a module coupling system for coupling two separate modules, comprising: a first module having a coupling housing with projecting arms that extend beyond the housing; a latch engagement feature such as a receiving pocket for a retractable catch; and a second module having a physical three-dimensional guide surface oriented along a longitudinal axis, the guide surface defining a support landing pad for the coupling housing of the first module on one end and a shoe housing on the other end that at least partially receives the coupling housing; a retractable catch movable between a released position and a latched position; and a visual indicator that indicates movement of the retractable catch to the latched position, wherein the first module is positively coupled to the second module by positioning of the first module relative to the second module so that the coupling housing is lowered into contact with the support landing pad and the coupling housing is then slid along the longitudinal axis until the retractable catch is received within the retractable catch receiving pocket of the first module to lock the first module in place relative to the second module, the visual indicator indicating movement to the latched position. The term pocket is used for convenience but the catch engagement feature could be a tab, pin, rib or other configuration that provides the ability to prevent sliding motion when acted upon by the catch.

In exemplary embodiments, a field-assembled component reprographic device is provided that includes: a first component module forming a reprographic device cover having at least one hinged coupling housing with projecting arms that extend beyond the housing, the hinged coupling having an upper housing pivotally connected to a lower housing by a pivot shaft, a catch feature, such as a pin provided on one of the upper and lower housings and a pivoting catch provided on the other of the upper and lower housings, the pivoting catch being biased to latch around the catch pin and lock the upper housing to the lower housing; and a pocket for receiving a retractable catch; and a second, separate component module forming a reprographic device base module having at least one physical three-dimensional guide surface oriented along a longitudinal axis, the guide surface defining a support landing pad for a corresponding coupling housing of the first module on one end and a shoe housing on the other end that at least partially receives the coupling housing; a retractable catch provided on the guide surface and movable between a released position and a latched position; and a visual indicator that indicates movement of the retractable catch to the latched position, wherein the first module may be positively coupled to the second module by positioning of the first module relative to the second module so that the coupling housing is lowered into contact with the support landing pad and the coupling housing is then slid along the longitudinal axis until the retractable catch is received within the pocket for receiving a retractable catch of the first module to lock the first module in place relative to the second module, the visual indicator indicating movement to the latched position, further wherein when the first module is coupled to the second module, the lower housing is at least partially received within the shoe housing and the upper housing is located above the shoe housing and the shoe housing and catch are arranged such that the shoe housing engages the catch to release engagement from the catch pin, allowing free rotation of the upper housing relative to the lower housing.

In various embodiments, methods of assembly and disassembly of module components are provided.

BRIEF DESCRIPTION OF THE DRAWINGS

Exemplary embodiments will be described with reference to the drawings, wherein:

FIG. 1 illustrates an exemplary hinged module assembly in which two separate pivoting modules are tandemly coupled and rotatable about a base module, such as a reprographic device, at least the lowermost pivoting module being coupled to the base module by a quick coupling mechanism;

FIG. 2 illustrates the reprographic device of FIG. 1 when the lowermost pivotable module has been fully raised to a substantially vertical position;

DETAILED DESCRIPTION OF EMBODIMENTS

Figure 3:
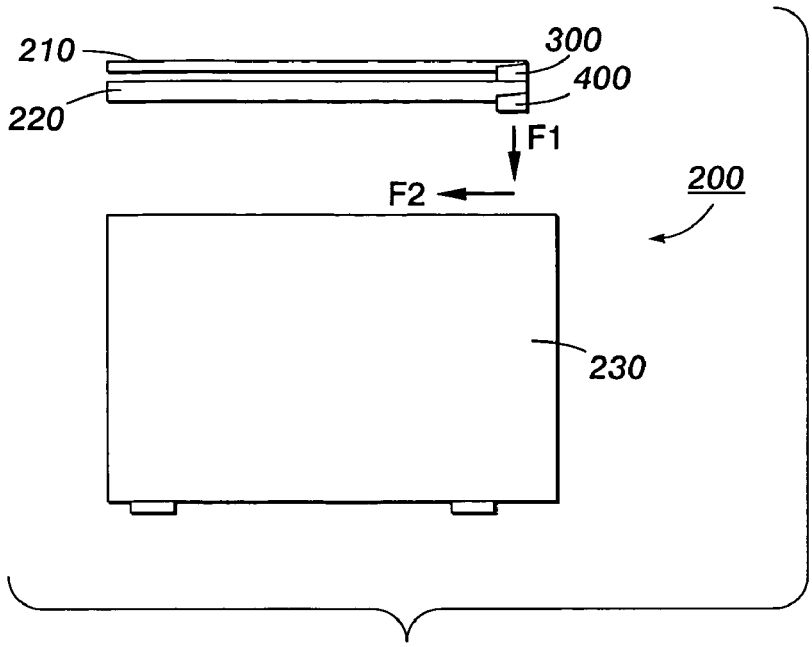
FIGS. 3–4 illustrate a simple assembly process for assembling separate module assemblies using a quick coupling mechanism preferably built-in to a hinge assembly.

FIGS. 1–6 illustrate an exemplary multi-module device having tandem pivoting modules, useable with various exemplary embodiments of the systems and methods described. In an exemplary form, an upper module may be tandemly coupled in piggyback fashion to a lower module, which also pivots. An example of this is shown in simplistic form in FIGS. 1–2. In an exemplary embodiment, a functional device 200 may be a reprographic device, such as a copier, printer, facsimile, or other similar device, and is preferably a multifunction device capable of scanning, as well as providing copying, printing, and/or facsimile transmission functionality. However, the device can take other forms, so long as its module components can be coupled by embodiments of the quick coupling mechanisms described. Exemplary reprographic device 200 is a solid ink printer that includes an upper pivoting module 210, a lower pivoting module 220, a first coupling hinge assembly 300 that pivotally couples the upper pivoting module 210 to the lower pivoting module 220, and a second coupling hinge assembly 400 that pivotally couples the lower module 220 relative to the base module 230 of the device.

The upper pivoting unit 210 may form a simple platen cover or an upper feeder unit having an auto feeding module that advances a recording media, such as paper, past a scanning head or scan platen. In an exemplary embodiment, the lower pivoting unit 220 forms a lower scan unit that contains the scanner platen. The scanned images can be reproduced by a marking engine provided in, for example, base 230.

First coupling hinge assembly 300 can take any conventional or subsequently developed form and allows rotational movement of upper pivot module 210 between a substantially horizontal closed position and a substantially vertical fully open position. However, module 210 may also be positioned at one or more intermediate positions. The functions and advantage of the coupling assembly 400 is applicable for quick secure coupling of two modules in the absence of an upper pivoting unit 210 and independent of the need for relative pivoting motion between units.

Second coupling hinge assembly 400 likewise allows rotation of lower pivoting module 220 between a closed substantially horizontal position (FIG. 1) and an open position (FIG. 2), which could be a fully open substantially vertical position, but preferably is a position less than vertical but sufficient to enable access to lower base device 230. Module 220 may also be opened to one or more intermediate positions. Although second coupling hinge assembly 400 can operate independent of operation of the first coupling hinge assembly 300, first coupling hinge assembly 300 preferably has movement operations that are at least partially dependent on the orientation or operation of the lower pivoting unit 220. Details of this can be found in co-pending U.S. patent application Ser. No. 11/018,531, the disclosure of which is hereby incorporated herein by reference in its entirety.

As illustrated in the simplified representations of FIGS. 3–6, the reprographic device 200 may come in a partially unassembled state consisting of two or more separate module assemblies. Although this exemplary embodiment shows three modules (feed module 210, scanner module 220, and base module 230), it is only necessary to have two separate modules. For example, there may only be a single upper or cover module and the base reprographic device module. Alternatively, as shown, the upper two modules (feed module 210 and scanner module 220) may remain attached as a unit. This separation of modules may be necessitated for shipping, manufacturing, replacement of module components, or other design or operation constraints. Thus, there is a need for a coupling mechanism that can readily attach and lock the modules together with a simple, yet precise movement. Similarly, the coupling mechanism should allow simple removal of the modules.

Figure 4:
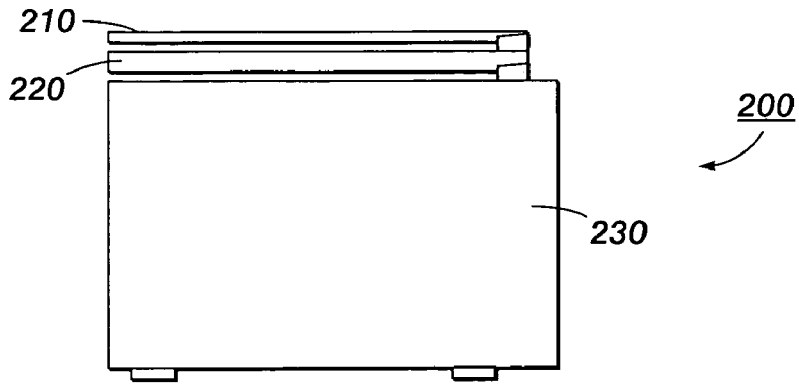
Figure 5:
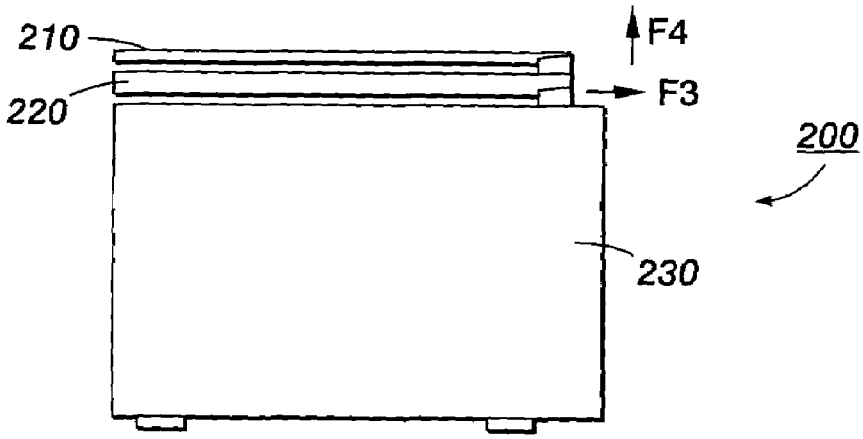
FIGS. 5–6 illustrate a simple removal process for releasing the upper module assemblies from the base module using a quick coupling mechanism.
Figure 6:
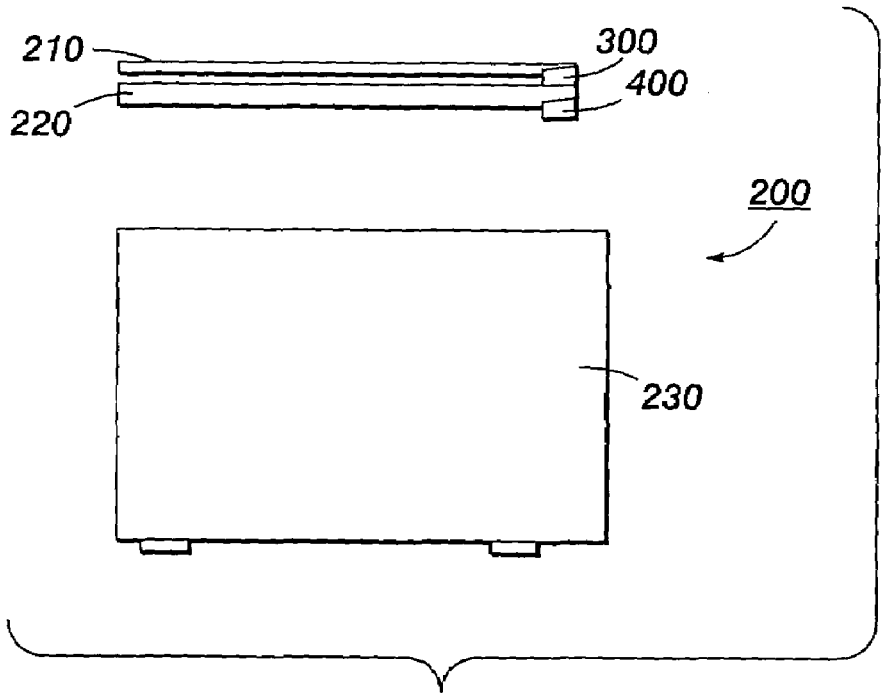

As shown in FIG. 3, the upper module (combination of scanner module 220 and feeder module 210, and will hereto be referred as the upper module 220) is initially separate from the base module 230. However, it can be simply coupled by placement of the upper module over the base module as shown, lowered by application of force F1 onto a landing support surface of the base module 230, and slid across the support surface with a force F2 until the upper module is lockingly engaged to the lower module (FIG. 4). Similarly, as shown in FIGS. 5–6, the two modules can be released from each other by a reverse operation involving release of a lock mechanism, sliding of the upper module relative to the lower module by application of force F3, and lifting the upper module upward by applying force F4 (FIG. 5). The method of bringing the two units or modules together is described as a two direction process of vertical and sliding motion, which is envisioned as the most user friendly and efficient means of attaching and releasing the upper and lower units. It should be noted that the connection can be accomplished by a longitudinal motion alone, so far as the present coupling hinge assembly is concerned.

Figure 7:
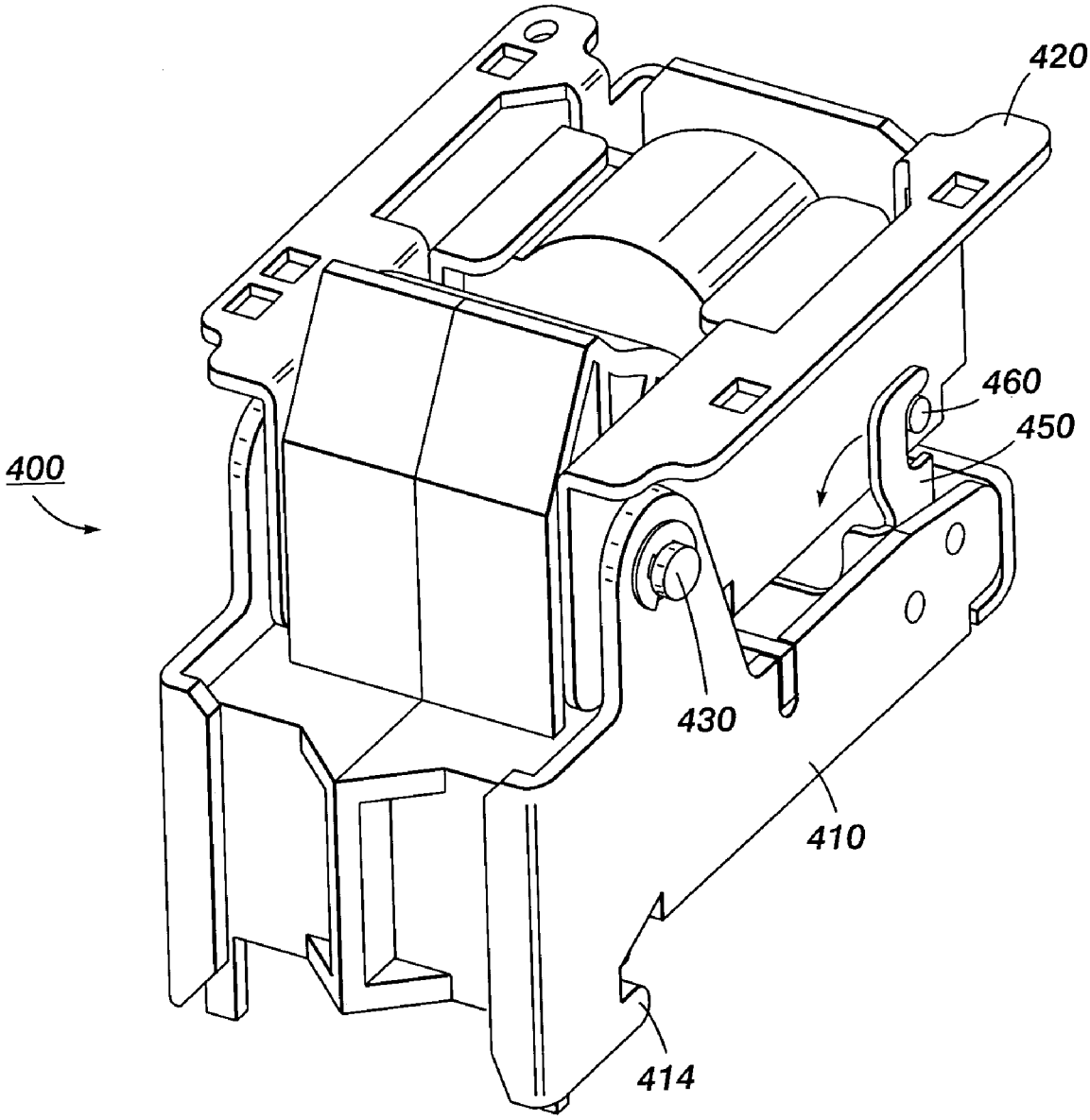
FIG. 7 illustrates a perspective view of an exemplary hinge assembly.
Figure 8:
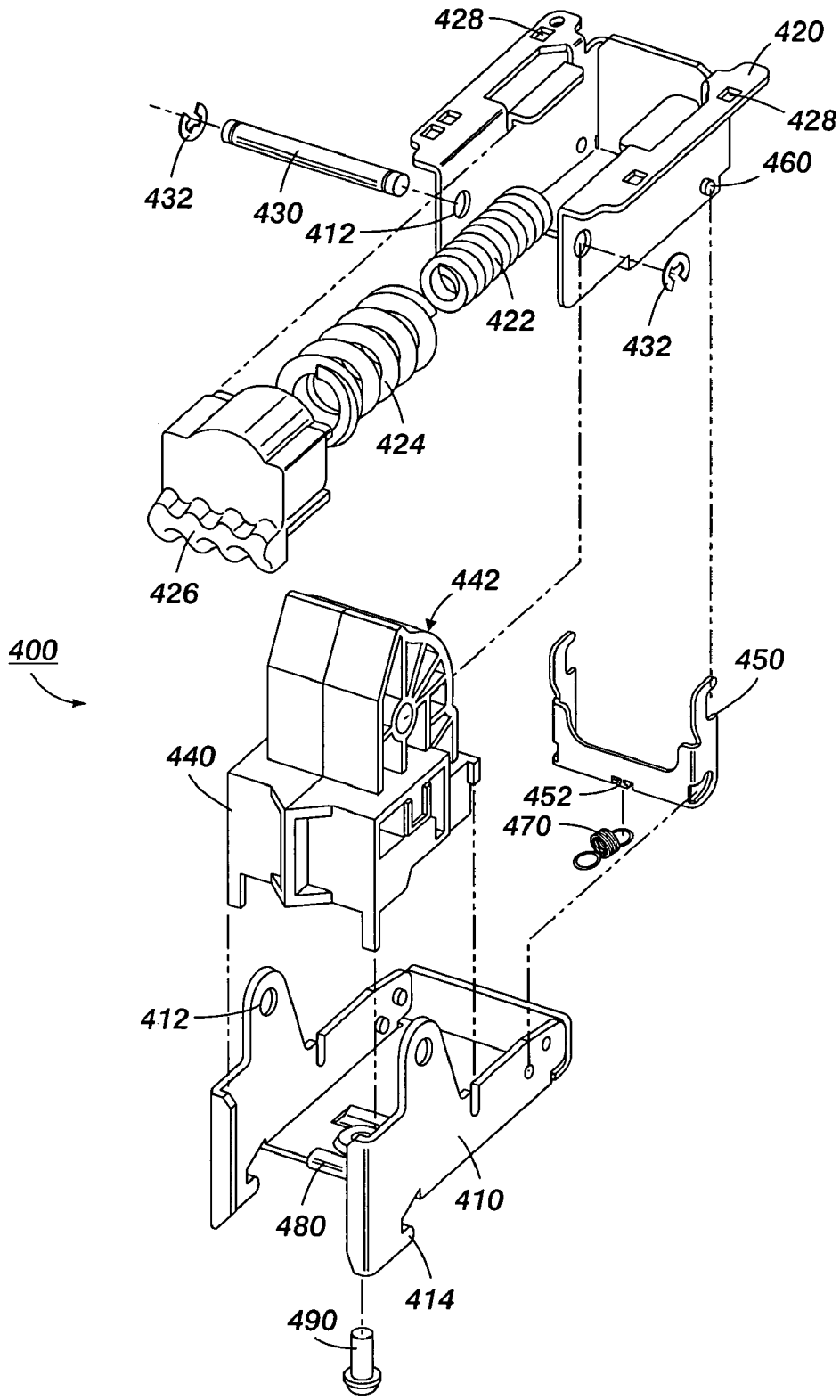
FIG. 8 illustrates an exploded view of the hinge assembly of FIG. 7.

FIGS. 7–8 illustrate an exemplary hinge assembly 400 that forms part of a quick coupling mechanism. Hinge assembly 400 includes a lower housing 410 and an upper housing 420 pivotally connected for relative rotation about pivot shaft 430, which is provided within pivot apertures 412. Pivot shaft 430 can be releasably retained within apertures 412 by, for example, C-clips 432. Lower housing 410 also includes at least one and preferably two projecting coupling arms 414 that protrude downward from the lower housing 410. Coupling arms 414 provide a guide feature that assists in alignment with corresponding structure on the base module as will be described later. Coupling arms 414 can also serve as a "heel" catch to prevent forward and/or vertical movement as will be described later.

Movement of the hinge assembly is controlled by cam 440 having a cam profile 442. Upper housing 420 includes a spring 424 and may, as necessary based on module mass and geometry, include a second spring 422 that bias a cam follower/plunger 426 against the cam profile 442 to control movement of the upper housing 420 between a closed position, in which the upper housing 420 is substantially parallel with the lower housing 410, and an open position, in which the upper housing 420 is at substantially a right angle to lower housing 410.

Figure 9:
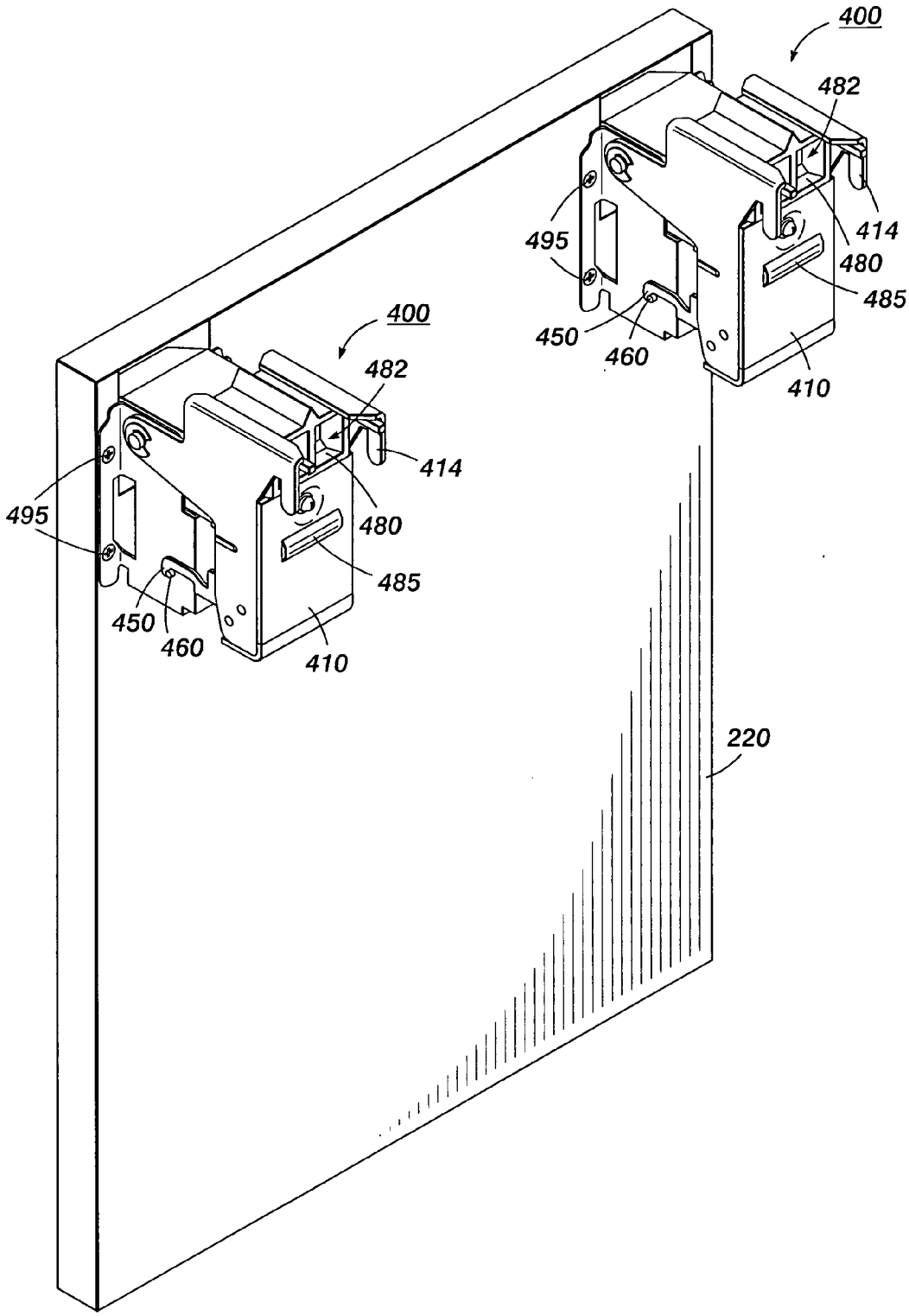
FIG. 9 illustrates a perspective underside view of an exemplary upper hinged module assembly showing a pair of hinge assemblies.

In a preferred embodiment, the hinge assembly 400 is provided with a biased lock that releasably locks the hinge assembly 400 in the closed position. This is particularly useful to prevent activation of the hinge assembly when the upper module is detached from the lower module. This also ensures a consistent orientation of the hinge and associated module for assembly or disassembly. The biased lock in an exemplary embodiment includes a pivoting latch 450 that engages a latch pin 460, which could also be a formed sheet metal protrusion or similar feature, to retain the upper and lower housings 420, 410 in fixed relationship. Pivoting latch 450 can be biased to the latched position by a suitable biasing element, such as a spring 470 coupled between the hinge latch 450 and lower housing 410. In this embodiment, spring 470 is attached to a suitably shaped protrusion 452 on the hinge latch and connected to housing 410 by a similar feature on housing 410. A spring screw 490 may be provided to hold the cam in place during assembly. A catch mating or engagement surface 480 may be formed on housing 410, such as an upward fold that provides a vertical engagement surface for mating with corresponding catches on the base module 230. Additionally, lower housing 410 can include a protrusion forming a coupling catch reset 485, as shown in FIG. 9.

Details of an exemplary guide coupling mechanism will be better described with reference to FIGS. 9–14. FIG. 9 shows the upper module 220 detached and separate from base module 230 and having a pair of hinge assemblies 400 mounted to the bottom side thereof by suitable attachment, such as screws 495, which mount through apertures 428 (FIG. 8). As shown, when the upper module 220 is "detached" from base module 230, the hinge assemblies 400 are locked in a closed position by latch hinges 450 encircling latch pins 460. As also shown in FIG. 9, the bottom of hinge assembly 400 includes one or more suitable vertical catch mating surfaces 480, either provided by a folded portion on lower housing 410 provided within recesses or pockets 482 of the cam, or provided by a surface of the recessed cam underside itself, serve as coupling stops that engage with corresponding structure on the base module, as will be described in more detail later.

Figure 10:
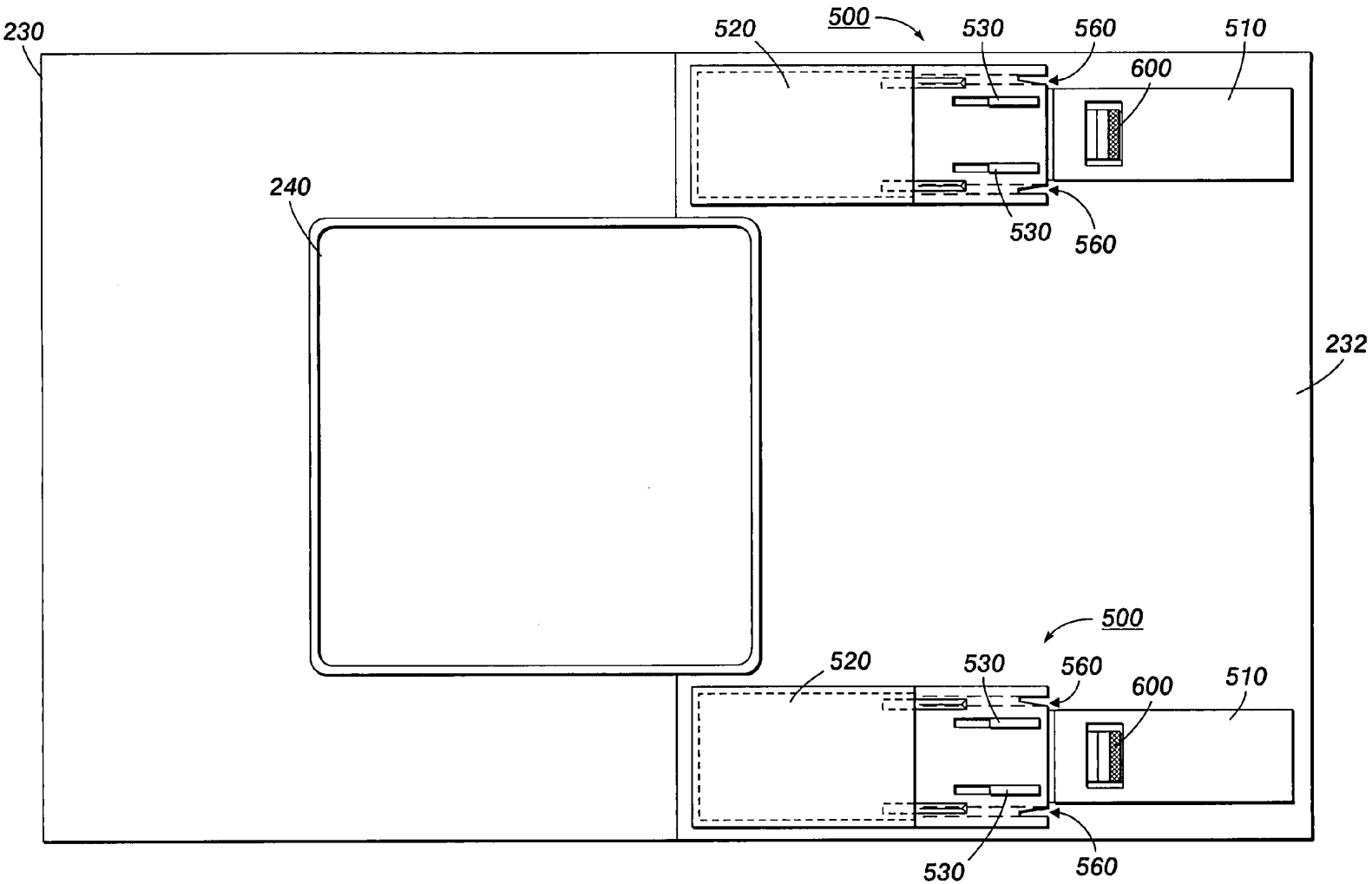
FIG. 10 illustrates a plan view of an exemplary base module, such as a reprographic device, having a quick coupling mechanism that mates with the hinge assemblies shown in FIG. 9.
Figure 11:
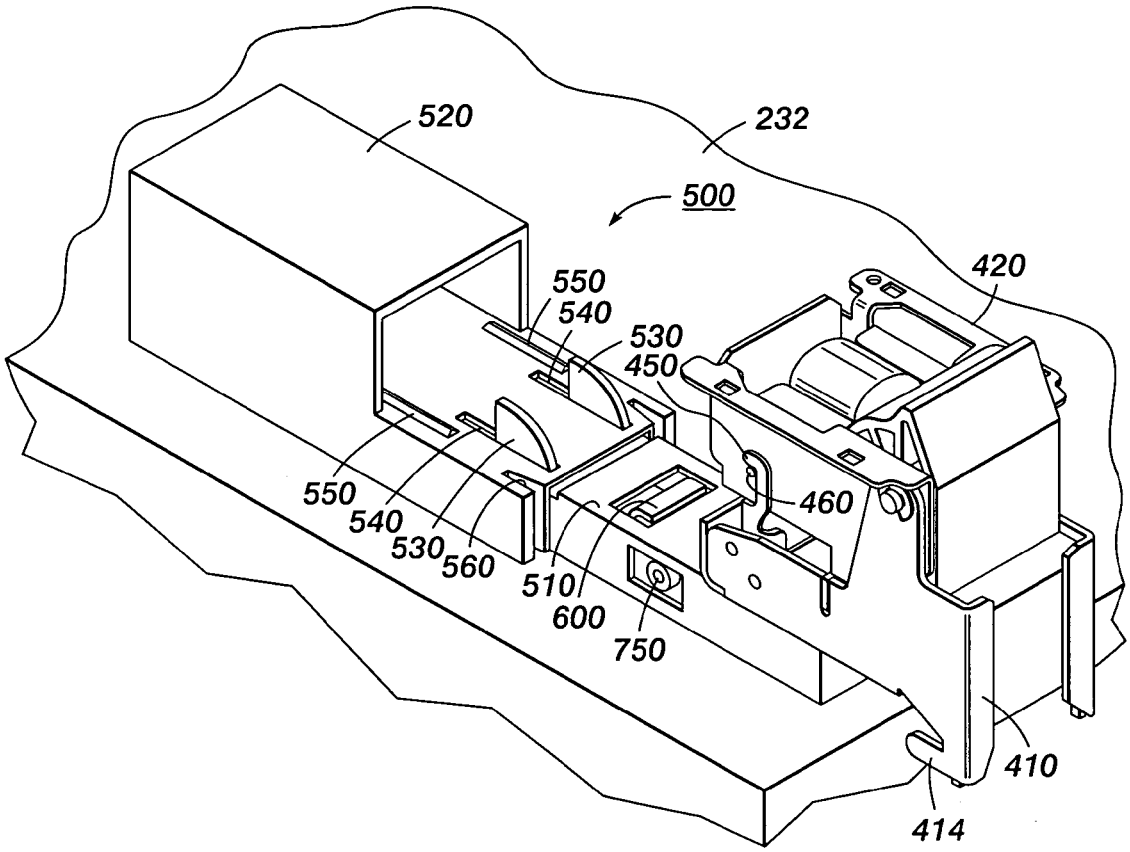
FIG. 11 illustrates a partial perspective view of an exemplary hinge assembly and corresponding landing support pad and shoe on the base module forming an exemplary quick coupling mechanism.

FIGS. 10–11 show a plan view and partial perspective view of the top of base module 230, respectively. For purposes of illustration, the upper module 220 is not shown. In this exemplary embodiment in which the base module is a reprographic device, base module 230 may include various internal components, such as a load or staging device for solid ink 240, and a print engine or other components that may need to be accessed for service by pivoting of the upper module to an open position (as in FIG. 2). Base module 230 forming a reprographic device includes a support 232 on which additional quick coupling mechanism components 500 are mounted. Quick coupling mechanism 500 includes a substantially flat but preferably raised guide surface 510 that enables sliding movement of hinge assembly 400 thereon. A far end of guide surface 510 includes a shoe housing 520 sized and shaped to matably receive at least a portion of lower housing 410, while not restraining pivotal movement of upper housing 420. Biased retractable catches 530 may be provided within openings 540. Catches 530 mate with engagement mating surfaces 480 and may partially extend within pockets 482 formed in the bottom of the cam (FIG. 9). One or more full or partial length guide rails 550 may be provided on the guide surface 510 to assist in maintaining proper orientation of the coupling components during guiding movement of the assembly process. This also reduces drag of the assembly to allow more efficient sliding. In the illustrated embodiment, lower housing 410 is sufficiently retained within shoe housing 520 such that the shoe housing engages latch 450 and disengages it from latch pin 460, allowing upper housing 420 to pivot relative to lower housing 410 (as better shown in FIG. 13).

Raised guide support surfaces 510 serve as a convenient "set down" landing pad on which the hinge assemblies 400 may be individually supported prior to installation. In accordance with various aspects, the set down landing may accommodate support and initial positioning functions for the corresponding upper module to encourage correct module orientation. In the illustrated embodiment, the protruding arms 414 are spaced to fit closely on each side of guide surface 510 to support and constrain movement of hinge assembly 400 substantially in line with guide surface 510.

In preferred exemplary embodiments, the "set down" landing pad surface 510 provides a support mechanism for a component assembler that supports a majority of the weight of the upper module 220 during slide coupling. This allows for the assembly of even heavy module components because the assembly does not need to be supported by the customer during the entire assembly process. Moreover, because the weight is supported, it may become easier for the customer to make any necessary relative position corrections to the module prior to full locking assembly of the module components.

In accordance with various aspects, when the module "foot" (hinge assembly 400) is inserted into the complementary quick coupling mechanism 500 of the other module, the guided module (220) may have its movement severely constrained. For example, guide surface 510 and arms 414 restrict lateral movement and allow primarily axial movement along guide surfaces 510. Upon full insertion of the hinge assembly 400 into the coupling mechanism 500, the protruding arms 414 engage features 560 and restrict vertical movement. Additionally, biased catches 530 engage with engagement surfaces 480. This constrains rearward movement in the direction of the guide to positively lock the hinge assembly 400 to the lower module 230. Thus, the two modules (220, 230) can be quickly guided into a positive locking and secure configuration through simple slide and latch movements.

In exemplary embodiments, one or more structures may act as a front stop. For example, protruding arms 414 can serve as a "heel" catch that engages with a heel catch engagement point 560 on the quick coupling mechanism 500 near the front of the shoe housing 520. Alternatively, housing 520 may have a back wall that abuts a front wall of lower hinge housing 410 to provide a front stop that limits forward movement. Similarly, lateral movement may be constrained by the side walls of housing 520 and/or arms 414 mating with guide surface 510. Thus, in exemplary embodiments, the two separate modules (220, 230) may be provided with a secure catch and positioning structure that can automatically lock one module against removal from the other module. In a preferred embodiment, the catch is near a point where sliding engagement reaches a hard stop.

Figure 12:
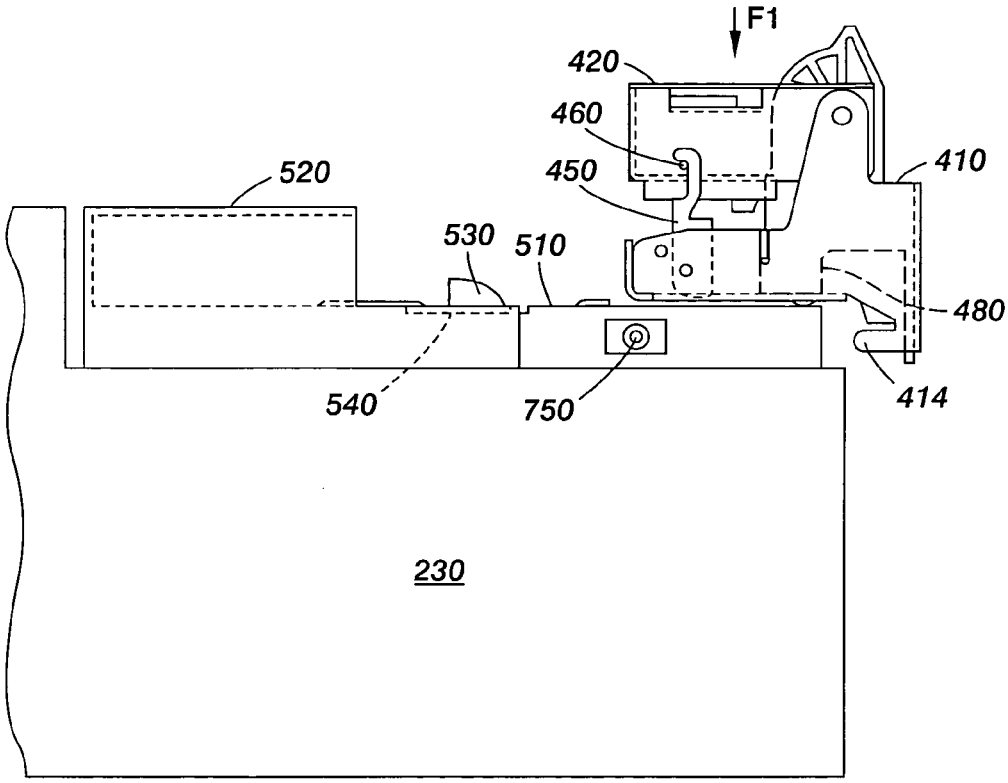
FIG. 12 illustrates a side view of the base module showing a landing pad support with the hinge assembly of an upper module initially placed on the landing pad support.
Figure 13:
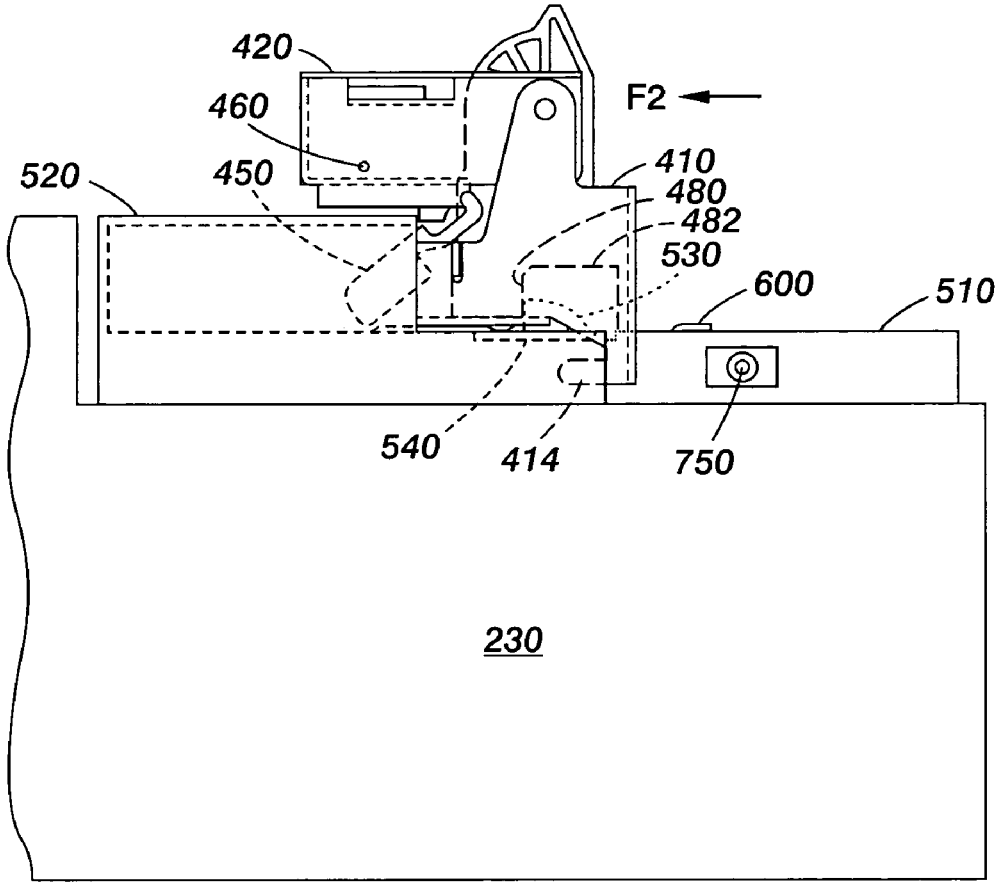
FIG. 13 illustrates a side view of the base module showing a landing pad support with the hinge assembly of an upper module slid into locking engagement with a shoe assembly of the quick coupling mechanism.
Figure 14:
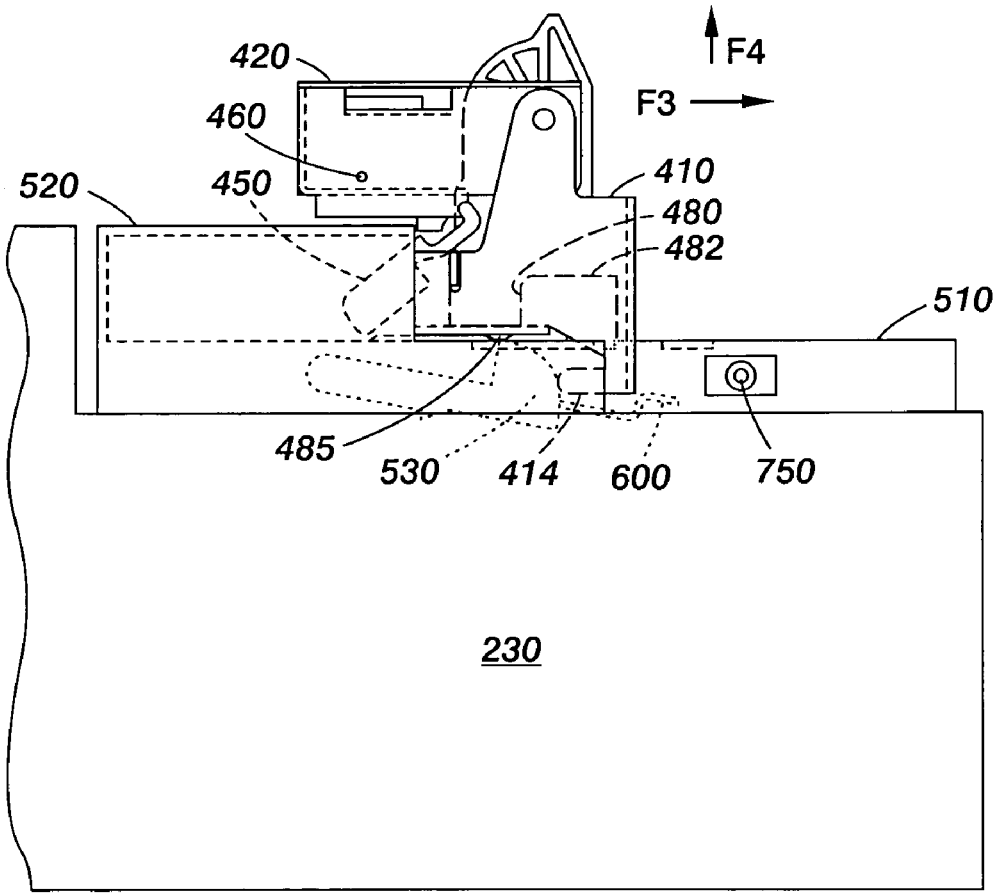
FIG. 14 illustrates a side view of the base module showing a landing pad support and a simple removal process for removal of the hinge assembly of an upper module from the shoe assembly of the quick coupling mechanism.

A better understanding of the sliding action of the exemplary quick coupling mechanism can be seen in FIGS. 12–14, which show the simple movements needed to couple and/or decouple the two modules. FIG. 12 shows a close-up partial cross-sectional view of the quick coupling mechanism including landing pad 510 and hinge assembly 400. For clarity in understanding, the upper module 220 is omitted, but would be rigidly mounted to hinge assembly 400 as shown in FIG. 9.

Positive coupling can be achieved with two simple movements. First, the upper module having hinge assemblies 400 thereon is positioned above base module 230 and lowered onto the landing pad guide surface 510 by application of downward force F1, resulting in the position shown in FIG. 12. Then, the upper module 220 is laterally slid along landing pad 510 and against a hard stop by horizontal force F2 as seen in FIG. 13 to precisely position and lock the hinge assemblies 400 in place on base module 230 of the reprographic device. In particular, sliding continues across catches 530, which can be biased to yield to the weight of the upper module 220. Once engagement surfaces 480 pass catches 530, catches 530 are urged into engagement surfaces 480 by a spring 575 (FIG. 15) and the biased catches 530 lock into place to form a rear stop that limits rearward movement. Also, as shown in FIG. 13, hinge assembly 400 is sufficiently slid into shoe housing 520 that a front wall thereof acts on catch 450 to pivot it against its biasing force out of locking arrangement with catch pin 460. This enables free rotation of the upper module relative to the lower module by rotation of hinge housing 420 relative to hinge housing 410. Thus, the hinge can be automatically locked when the upper module 220 is uncoupled but can also be automatically released upon coupling with base module 230. Additionally, "heel" catches formed by protruding arms 414 can be abutted against "heel" catch engagement points 560 near the front of shoe housing 520 to serve as stops that can limit forward movement and does prevent vertical lifting at that point. It is this interlocked condition that imparts a solid connection between the two units so the primary sense of possible relative motion between them is the intended pivot motion of the mounted module.

Visual indicators may be provided at each of two widely separated parallel coupling assemblies to provide positive feedback that a desired locked condition has been attained. These visual indicators, such as indicators 600, are preferably a component of the pivoting catches 530 so that the visual indication of a locked state cannot occur unless the module being coupled is fully in place (i.e., catches 530 is fully received and locked within pockets 480). That is, upon full locking of pivoting catches 530 against engagement surfaces 480, visual indicators 600 will be moved to a position above the guide surface 510, as shown, by suitable linkage. Failure to attain the visual lock indication signals that a further nudge of the module is needed on the side not visibly locked. Adequately applied, this further motion will result in full engagement with visual lock verification. Thus, a reliable positive coupling can be simply achieved and verified without assembly tools and without the need for an experienced installer.

Removal of the upper module from the base module 230 is just as simple. First, as shown in FIG. 14, a suitable catch decoupling device is depressed. A more thorough description of the functionality of the decoupling device will be explained in detail with regard to FIGS. 16–19 in a following paragraph. In exemplary embodiments, this may be accomplished by simply sliding at least a portion of catch decoupling device 700 associated with biased catches 530 backward, such as with any small object like a screwdriver, Allen wrench, pen, paper clip or the like inserted through catch decoupling device 700 to unlock the coupling of the catch 530 from the hinge assembly 400. The catch decoupling device 700 may be designed to latch in the decoupled position so that the user does not have to hold it. As the module is slid out of the constraining features of the catch, the lock or catch enabled state of the catch is automatically returned so that it is ready to relock the module when reassembled. Additionally, it may be possible to use visual indicator 600 as a decoupling mechanism, when it is suitably coupled to the catches 530. For example, pressing down of indicator 600 may cause decoupling of catches 530 from within pockets 482 containing engagement surfaces 480. Catches 530 and visual indicator 600 can be elements of an integrated part that pivots near the front of coupling 500, for example, under shoe housing 520. Thus, when catches 530 rise, the visual indicator 600 rises and when the catch is lowered the indicator is lowered. Actuating the catch decoupling device 700, which in the present embodiment is a sliding action, can cause an incline plane feature which is part of the catch decoupling device 700 to push downward on a pivoting part, which incorporates catches 530 and indicator 600, to release the catch from engagement with surfaces 480 of the hinge assembly 400. This same action can be made to automatically hold the catches 530 in the decoupled condition by allowing a portion of the upwardly biased catch part to block the device 700 so the catch temporarily remains in this state. In this decoupled condition, the upper portions of catches 530 remain slightly above the guide surface 510 but the profile of the engaging portions of catches 530 and catch engagement surfaces 480 allow the hinge assembly to slide beyond the catch. As the hinge assembly is slid past the catches 530 in this position, it is forced by the underside of the lower housing 410, such as by protrusion 485 in FIGS. 9 and 14 to move the rest of the way down out of the way where it disengages from the catch decoupling device 700. This series of actions serves as a reset trigger and causes the catch enabled condition to be automatically restored once the hinge assembly 400 is moved beyond the catches 530.

After catch decoupling device 700 is actuated, the hinge assembly 400 is free to be removed by application of force F3 as shown in FIG. 14, at which time the hinge assembly is slid backwards on the guide surface 510 and force F4 is applied to lift and remove the upper module.

Figure 15:
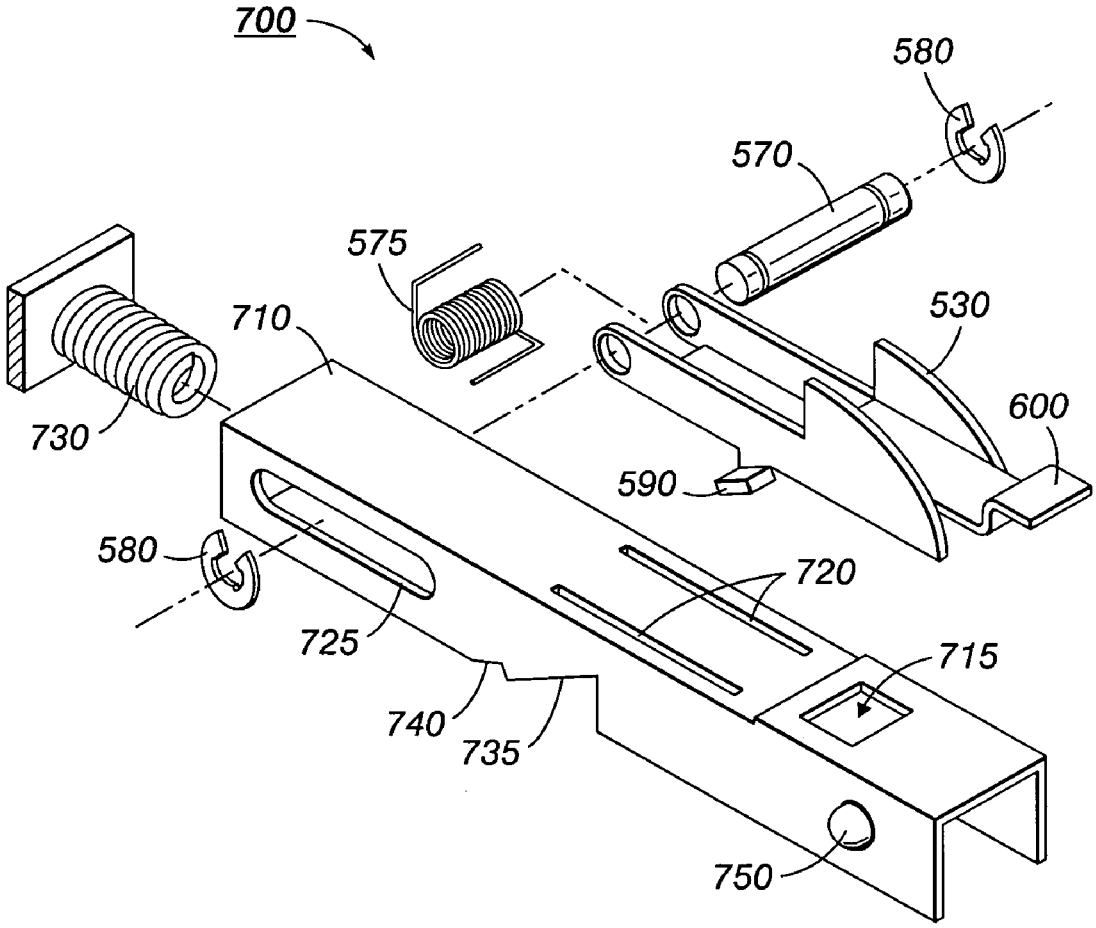
FIG. 15 illustrates an exploded perspective view of an exemplary catch release device.

An exemplary catch decoupling device 700 will be described with reference to FIG. 15. FIG. 15 is an exploded perspective view of various components. Exemplary catches 530 are shown pivotally connected to pivot shaft 570. Catches 530 are biased by a spring 575 provided on shaft 575. The catches 530 are retained by c-clips 580 and contain at least one and preferably two guide tabs 590 and in a preferred embodiment are attached, in the same part, with visual indicators 600.

Catches 530 are pivotally mounted within catch decoupling device 700. Catch decoupling device 700 is preferably formed from a base 710 having a U-shaped channel. Opening 715 selectively receives visual indicator 600 therethrough while openings 720 allow catches 530 to extend therethrough. Pivot shaft 570 is fixedly mounted to a frame of base module 230 (unshown) through elongated slots 725 of the device 700. This allows for sliding movement of the base 710 of device 700 relative to the pivot shaft 570 and biased catches 530. Base 710 is preferably biased to a first position by a suitable biasing force, such as by spring 730. Base 710 also includes an inclined plane ramp structure provided on the side profile of the device. In a preferred embodiment, the ramp structure includes a main ramp profile 735 and a much smaller secondary ramp profile 740. However, the second ramp profile could be formed by a notch. Lateral movement of device 700 can be achieved, for example, by inserting a small object such as an Allen wrench or pen into pull feature 750. Alternatively, a release handle or external tab could be provided as a pull feature for manual manipulation of the device 700.

Figure 16:
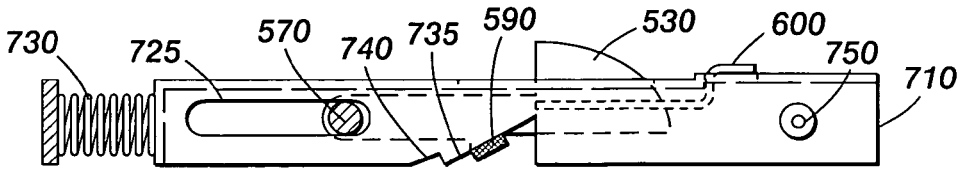
FIGS. 16–19 illustrate side views of the catch release device of FIG. 15 in various operating positions.

Specific details of an exemplary implementation of the catch decoupling device 700 will be described with reference to FIGS. 16–19. A lock enabled or catch enabled state is shown in FIG. 16. This is an initial position prior to coupling of the upper module onto the base module. In this state, tab 590 is located near the end of ramp profile 735. This allows biased catches 530 to extend through openings 720 as well as openings 540 (FIG. 11). During the sliding of the hinge assembly 400 across the catches, the catches 530 are urged against the force of spring 575 until the engagement features 480 pass catches 530. At this time, biased catches 530 are urged upwards by spring 575 into mating engagement with the engagement features 480 to couple the hinge assembly (FIG. 13).

Figure 17:
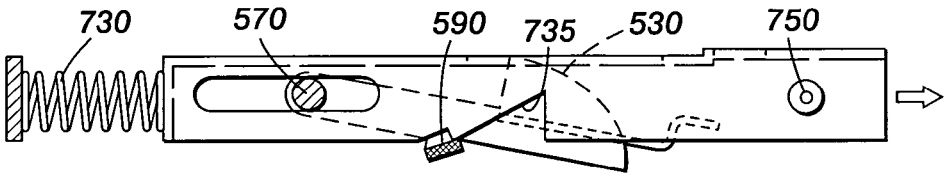
Figure 18:
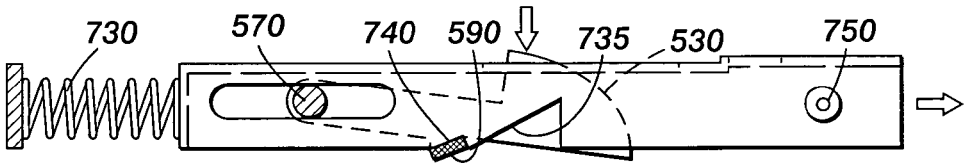
Figure 19:
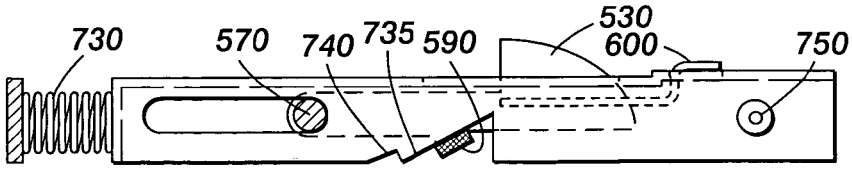

When it is desired to decouple the hinge assembly, pull feature 750 is manipulated to slide catch decoupling device 700 in the direction of the arrow in FIG. 17. For example, a screwdriver may be inserted into opening 750 and pulled in the direction of the arrow to move the base 710. This forces tab 590 to follow the contour of the ramp profile 735, which lowers catches 530 as shown so they are substantially recessed from the top surface of base 710. As shown in FIG. 18, sliding of base 710 continues until tab 590 engages with and is received within the smaller secondary ramp profile 740. This temporarily locks the catch decoupling device 700 in a seconds decoupled position in which the biased catches are slightly raised from surface 710. At this time, the hinge assembly 400 can be slid in the direction F3 as shown in FIG. 14 and removed. During this removal of hinge assembly 400, it is possible to reset the catch decoupling device 700 to its initial position (i.e. return of the catches 530 to the catch enabled state) using a catch reset mechanism. This can be achieved by applying slight downward pressure on biased catches 530 as shown in FIG. 18. This lowers tab 590 sufficiently that it disengages from ramp profile 540. Preferably, this reset is performed automatically. One way in which this automatic reset can be achieved is by contact of protrusions 485 (FIGS. 9 and 14) with the biased catches 530 during removal of the hinge assembly 400. The protrusions 485 serve as a catch reset trigger that initiates the reset. Due to the bias of spring 730, and the ramp profile 735 as shown, slide catch decoupling device 700 is returned to its catch enabled state (FIG. 19).

The exemplary embodiments as set forth above are intended to be illustrative, not limiting. Various changes may be made without departing from the spirit and scope of the invention. For example, although preferred embodiments show use of a hinge assembly 400, the upper module 220 does not need to have hinging features. Rather, the coupling mechanism may just provide quick coupling and release of the two independent module components. Therefore, the claimed systems and methods are intended to embrace all known, or later-developed, alternatives, modifications, variations, and/or improvements.

What is claimed is:

1. A module coupling system for coupling two separate modules, comprising:

a first module having a coupling housing with projecting arms that extend beyond the housing;

a catch engagement surface; and a second module having a physical three-dimensional guide surface oriented along a longitudinal axis, the guide surface defining a support landing pad for the coupling housing of the first module on one end and a shoe housing on the other end that at least partially receives the coupling housing;

a retractable catch movable between a catch enabled position capable of mating with the catch engagement surface of the first module and a latched, decoupled position at which the retractable catch is decoupled from the catch engagement surface of the first module;

a catch decoupling device that is movable to position the retractable catch at the latched, decoupled position to decouple the retractable catch from the catch engagement surface; and a catch reset mechanism that automatically resets the retractable catch to the catch enabled position upon removal of the first module.

2. The module coupling system for coupling two separate modules according to claim 1, further comprising a visual indicator that indicates positioning of the retractable catch at the latched, decoupled position from the catch enabled position, wherein the first module is positively coupled to the second module by positioning of the first module relative to the second module so that the coupling housing is moved into contact with the support landing pad and the coupling housing is then slid along the longitudinal axis until the retractable catch is engaged with the catch engagement surface of the first module to lock the first module in place relative to the second module, the visual indicator indicating the position of the retractable catch.

3. The module coupling system for coupling two separate modules according to claim 1, wherein the first coupling housing is a hinge assembly having an upper housing pivotally connected to a lower housing by a pivot shaft, further wherein when the first module is coupled to the second module, the lower housing is at least partially received within the shoe housing and the upper housing is located above the shoe housing and unconstrained for movement by the shoe housing.

4. The module coupling system for coupling two separate modules according to claim 3, further comprising a catch pin provided on one of the upper and lower housings and a pivoting catch provided on the other of the upper and lower housings, the pivoting catch being biased to latch around the catch pin and lock the upper housing to the lower housing when the first module is decoupled from the second module and upon coupling, the shoe housing and catch are arranged such that the shoe housing engages the catch to release engagement from the catch pin, allowing free rotation of the upper housing relative to the lower housing.

5. The module coupling system for coupling two separate modules according to claim 1, wherein the second module is part of a reprographic device and the first module is a cover module of the reprographic device.

6. The module coupling system for coupling two separate modules according to claim 5, wherein the reprographic device is a solid ink printer.

7. The module coupling system for coupling two separate modules according to claim 1, wherein the first module includes two separated coupling housings and the second module includes two corresponding separated guide surfaces.

8. The module coupling system for coupling two separate modules according to claim 1, wherein the projecting arms of the at least one coupling housing are spaced substantially the width of the guide surface so that upon positioning of the at least one coupling housing on the landing pad of the guide surface, the coupling housing is supported by the guide surface and the projecting arms are closely adjacent to side walls of the guide surface to substantially constrain movement of the coupling housing to axial sliding movement along the guide surface.

9. The module coupling system for coupling two separate modules according to claim 8, wherein the combination of the projecting arms and the guide surface provide mount and locate features that enable easy alignment and assembly of the modules.

10. The module coupling system for coupling two separate modules according to claim 8, further comprising a heel catch that engages a heel catch engagement point of the shoe housing to provide an interlock that limits vertical movement of the coupler housing.

11. The module coupling system for coupling two separate modules according to claim 1, wherein the catch decoupling device includes an inclined ramp profile that positions the retractable catch at the latched, decoupled position.

12. The module coupling system for coupling two separate modules according to claim 1, wherein the catch reset mechanism that automatically resets the retractable catch to the catch enabled position upon removal of the first module includes a spring that biases the catch decoupling device and a catch reset trigger.

13. A field-assembled component reprographic device, comprising:

a first component module forming a upper reprographic device having a coupling housing with projecting arms that extend beyond the housing and a catch engagement surface; and a second, separate component module forming a reprographic device base module having at least one physical three-dimensional guide surface oriented along a longitudinal axis, the guide surface defining a support landing pad for a corresponding coupling housing of the first module on one end and a shoe housing on the other end that at least partially receives the coupling housing;

a retractable catch provided on the guide surface and movable between a catch enabled position capable of mating with the catch engagement surface of the first component module and a latched, decoupled position at which the retractable catch is decoupled from the catch engagement surface;

a catch decoupling device that is movable to slide the retractable catch to the latched, decoupled position to decouple the catch from the catch engagement surface; and a catch reset mechanism that automatically resets the retractable catch to the catch enabled position upon removal of the first module, wherein the first module may be positively coupled to the second module by positioning of the first module relative to the second module so that the coupling housing is lowered into contact with the support landing pad and the coupling housing is then slid along the longitudinal axis until the catch is engaged with the catch engagement surface of the first module to lock the first module in place relative to the second module.

14. The field-assembled component reprographic device according to claim 13, wherein the first module includes two separated coupling housings and the second module includes two corresponding separated guide surfaces.

15. The field-assembled component reprographic device according to claim 13, further comprising a visual indicator that indicates positioning of the retractable catch at the latched, decoupled position from the catch enabled position, wherein the first module is positively coupled to the second module by positioning of the first module relative to the second module so that the coupling housing is moved into contact with the support landing pad and the coupling housing is then slid along the longitudinal axis until the retractable catch is engaged with the catch engagement surface of the first module to lock the first module in place relative to the second module, the visual indicator indicating the position of the retractable catch.

16. The field-assembled component reprographic device according to claim 13, wherein the catch decoupling device includes an inclined ramp profile that positions the retractable catch at the latched, decoupled position.

17. The field-assembled component reprographic device according to claim 13, wherein the catch reset mechanism that automatically resets the retractable catch to the catch enabled position upon removal of the first module includes a spring that biases the catch decoupling device and a coupling catch reset trigger.

18. A method of assembling the component field-assembled reprographic device of claim 13, comprising:

positioning the first module above the second module;

aligning the at least one coupling housing with the corresponding guide surface;

lowering the first module until the at least one coupling housing is supported on the landing pad of the second module; and sliding the first module along the guide surface until the retractable catch is received within a retractable catch receiving pocket of the first module containing the catch engagement surface.

19. A method of disassembling the component field-assembled reprographic device of claim 13, comprising:

disengaging the retractable catch by moving the catch decoupling device having an inclined ramp profile that positions the retractable catch at the latched, decoupled position;

sliding the first module along the guide surface onto the landing pad; and lifting the first module from the second module.

20. The method of disassembling the component field-assembled reprographic device of claim 19, wherein during the sliding, the catch reset mechanism automatically resets the retractable catch to the catch enabled position upon removal of the first module.

* * * * *